US005871133A

United States Patent [19]

Robinson

[11] Patent Number: 5,871,133

[45] Date of Patent: Feb. 16, 1999

[54] GARMENT BAG BACKPACK

[76] Inventor: Ricky B. Robinson, 207 Cross St., Bolivar, Tenn. 38008

[21] Appl. No.: 959,479

[22] Filed: Oct. 30, 1997

[51] Int. Cl.[6] ..... A45F 3/08; B65D 85/18

[52] U.S. Cl. ..... 224/634; 206/287.1; 206/288; 224/628

[58] Field of Search ..... 224/634, 153, 224/654; 223/84, 85; 206/287.1, 284, 288, 289, 290, 291, 292; 190/111, 15.1, 13 R

[56] References Cited

U.S. PATENT DOCUMENTS 2,596,412 5/1952 Kish et al. ..... 206/292
3,002,666 10/1961 Silverman ..... 224/927
4,901,897 2/1990 Briggs et al. ..... 224/153
5,154,332 10/1992 Williams et al. ..... 224/153

*Primary Examiner*—Allan N. Shoap
*Assistant Examiner*—Maerena W. Brevard

[57] ABSTRACT

A garment bag backpack for freeing a user's hands while traveling. The inventive device includes a main support having a pair of shoulder straps secured thereto. The main support has a waist strap secured thereto. The shoulder straps and the waist strap couple the main support to a torso of a user. A pair of garment supports are rotatably coupled with the main support. Each of the garment supports have a generally U-shaped configuration. A cover is dimensioned for positioning over the main support and the pair of garment supports. The cover has zippered closure.

9 Claims, 2 Drawing Sheets

GARMENT BAG BACKPACK

BACKGROUND OF THE INVENTION

1. Field of the Invention

The present invention relates to backpacks and more particularly pertains to a new garment bag backpack for freeing a user's hands while traveling.

2. Description of the Prior Art

The use of backpacks is known in the prior art. More specifically, backpacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art backpacks include U.S. Pat. No. 5,259,539 to Brotman; U.S. Pat. No. 4,236,657 to Brunton; U.S. Pat. No. 4,655,343 to Lane et al.; U.S. Pat. No. 4,901,897 to Briggs et al.; U.S. Pat. No. Des. 308,912 to Lee; and U.S. Pat. No. 4,015,759 to Dreissigacker et al.

While these devices fulfill their respective, particular objectives and requirements, the aforementioned patents do not disclose a new garment bag backpack. The inventive device includes a main support having a pair of shoulder straps secured thereto. The main support has a waist strap secured thereto. The shoulder straps and the waist strap couple the main support to a torso of a user. A pair of garment supports are rotatably coupled with the main support. Each of the garment supports have a generally U-shaped configuration. A cover is dimensioned for positioning over the main support and the pair of garment supports. The cover has zippered closure.

In these respects, the garment bag backpack according to the present invention substantially departs from the conventional concepts and designs of the prior art, and in so doing provides an apparatus primarily developed for the purpose of freeing a user's hands while traveling.

SUMMARY OF THE INVENTION

In view of the foregoing disadvantages inherent in the known types of backpacks now present in the prior art, the present invention provides a new garment bag backpack construction wherein the same can be utilized for freeing a user's hands while traveling.

The general purpose of the present invention, which will be described subsequently in greater detail, is to provide a new garment bag backpack apparatus and method which has many of the advantages of the backpacks mentioned heretofore and many novel features that result in a new garment bag backpack which is not anticipated, rendered obvious, suggested, or even implied by any of the prior art backpacks, either alone or in any combination thereof.

To attain this, the present invention generally comprises a main support having a generally rectangular configuration. The main support has a short upper edge, a short lower edge and a pair of long side edges. The main support has a pair of shoulder straps secured thereto disposed inwardly of the long side edges thereof. The main support has a waist strap secured thereto disposed upwardly of the short lower edge. The shoulder straps and the waist strap couple the main support to a torso of a user. A pair of cylindrical sleeves are secured to a rear surface of the main support. The sleeves are disposed in a parallel relationship with respect to the long side edges. The sleeves each have an open upper end and a closed lower end. The open upper end of one of the sleeves is disposed at a higher elevation than of the opposing sleeve. A pair of handles are rotatably disposed within the pair of cylindrical sleeves. Each of the handles has an elongated shaft slidably received within the open upper ends of the sleeves. Each shaft has an inwardly turned upper end. A pair of garment supports are secured to the elongated shafts of the pair of handles. The garment supports are orthogonally disposed with respect to the elongated shafts. Each of the garment supports has a generally U-shaped configuration. The garment supports have a length less than a distance between the pair of cylindrical sleeves. A cover is dimensioned for positioning over the main support, the cylindrical sleeves, the pair of handles and the pair of garment supports. The cover has a pair of apertures in an upper end thereof for receiving the inwardly turned upper ends of the handles therethrough. The cover has a zippered closure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new garment bag backpack apparatus and method which has many of the advantages of the backpacks mentioned heretofore and many novel features that result in a new garment bag backpack which is not anticipated, rendered obvious, suggested, or even implied by any of the prior art backpacks, either alone or in any combination thereof.

It is another object of the present invention to provide a new garment bag backpack which may be easily and efficiently manufactured and marketed.

It is a further object of the present invention to provide a new garment bag backpack which is of a durable and reliable construction.

An even further object of the present invention is to provide a new garment bag backpack which is susceptible of a low cost of manufacture with regard to both materials and labor, and which accordingly is then susceptible of low prices of sale to the consuming public, thereby making such garment bag backpack economically available to the buying public.

Still yet another object of the present invention is to provide a new garment bag backpack which provides in the apparatuses and methods of the prior art some of the advantages thereof, while simultaneously overcoming some of the disadvantages normally associated therewith.

Still another object of the present invention is to provide a new garment bag backpack for freeing a user's hands while traveling.

Yet another object of the present invention is to provide a new garment bag backpack which includes a main support having a pair of shoulder straps secured thereto. The main support has a waist strap secured thereto. The shoulder straps and the waist strap couple the main support to a torso of a user. A pair of garment supports are rotatably coupled with the main support. Each of the garment supports have a generally U-shaped configuration. A cover is dimensioned for positioning over the main support and the pair of garment supports. The cover has zippered closure.

Still yet another object of the present invention is to provide a new garment bag backpack that reduces the strain experienced when carrying garments while traveling.

Even still another object of the present invention is to provide a new garment bag backpack that helps individuals more evenly distribute the weight of garments while traveling or when otherwise transporting clothing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
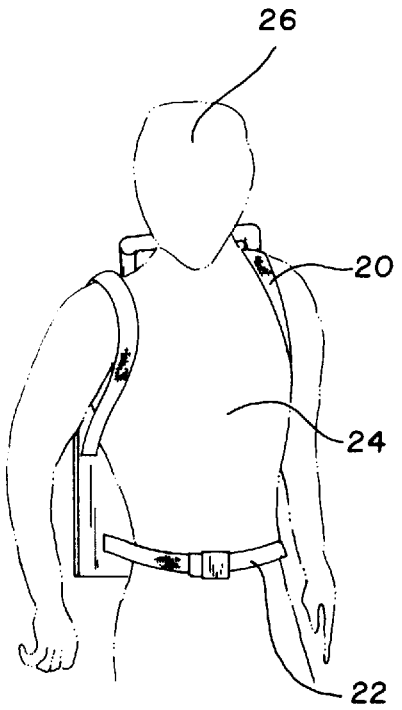
FIG. 1 is a front view of a new garment bag backpack according to the present invention illustrated in use.
Figure 2:
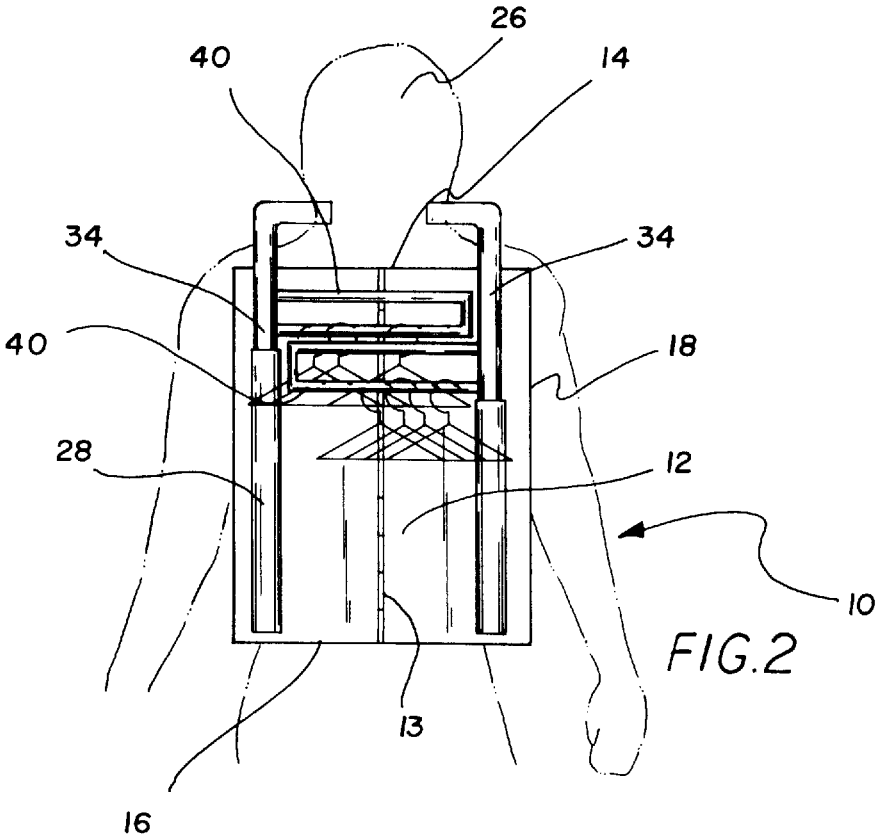
FIG. 2 is a rear elevation view of the present invention illustrated in use.
Figure 3:
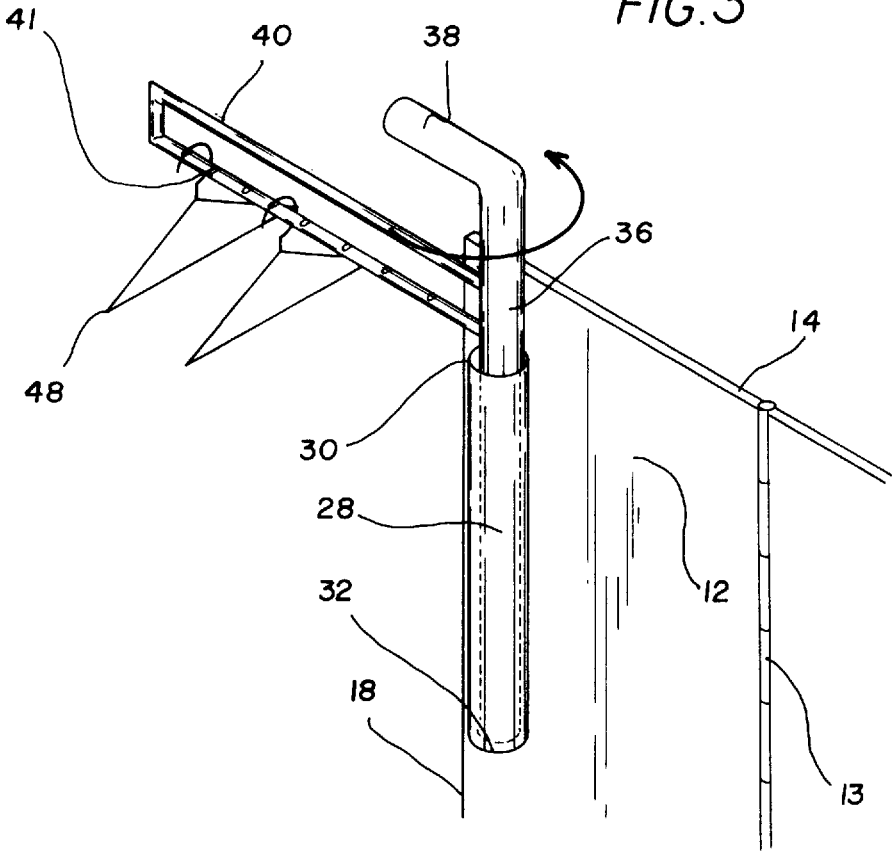
FIG. 3 is a fragmentary perspective view of the present invention illustrating the one of the garment supports thereof.
Figure 4:
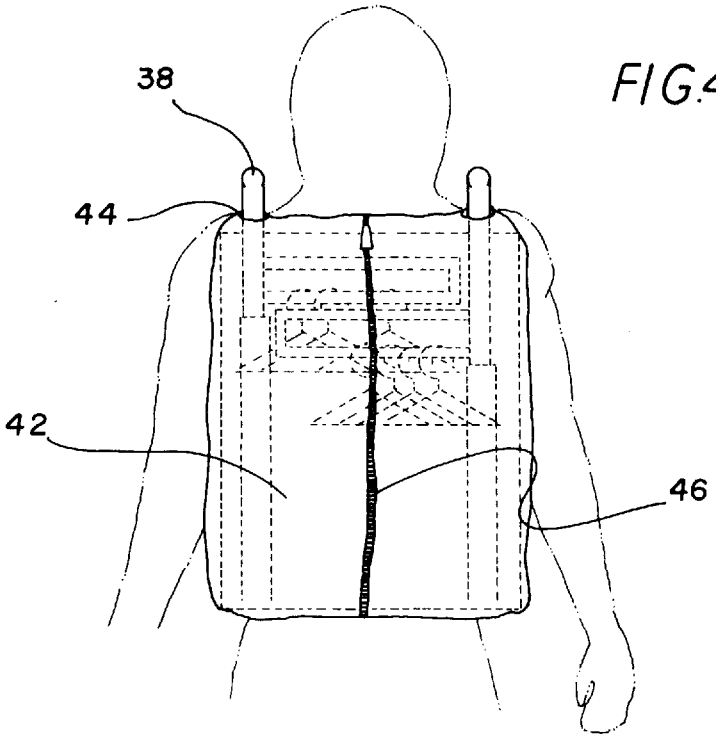
FIG. 4 is a rear view of the present invention shown with the cover in place.

With reference now to the drawings, and in particular to FIGS. 1 through 4 thereof, a new garment bag backpack embodying the principles and concepts of the present invention and generally designated by the reference numeral 10 will be described.

As best illustrated in FIGS. 1 through 6, the garment bag backpack 10 comprises a main support 12 having a generally rectangular configuration. The main support 12 has a hinge 13 extending across its central extent to allow the main support 12 to be folded in half when not in use. The main support 12 has a short upper edge 14, a short lower edge 16 and a pair of long side edges 18. The main support 12 has a pair of shoulder straps 20 secured thereto disposed inwardly of the long side edges 18 thereof. The pair of shoulder straps 20 are preferably of the adjustable variety in order to accommodate various sized users. The main support 12 has a waist strap 22 secured thereto disposed upwardly of the short lower edge 16. The waist strap 22 is also preferably adjustable. The shoulder straps 20 and the waist strap 22 couple the main support 12 to a torso 24 of a user 26. Additionally, the main support 12 could be incorporated with a padded nylon cover to provide greater comfort to the wearer.

A pair of cylindrical sleeves 28 are secured to a rear surface of the main support 12. The sleeves 28 are disposed in a parallel relationship with respect to the long side edges 18. The sleeves 28 each have an open upper end 30 and a closed lower end 32. The open upper end 30 of one of the sleeves 28 is disposed at a higher elevation than of the opposing sleeve 28. Note FIG. 2.

A pair of handles 34 are rotatably disposed within the pair of cylindrical sleeves 28. Each of the handles 34 has an elongated shaft 36 slidably received within the open upper ends 30 of the sleeves 28. Each shaft 36 has an inwardly turned upper end 38.

A pair of garment supports 40 are secured to the elongated shafts 36 of the pair of handles 34. The garment supports 40 are orthogonally disposed with respect to the elongated shafts 36. Each of the garment supports 40 has a generally U-shaped configuration. The garment supports 40 have a length less than a distance between the pair of cylindrical sleeves 28. The garment supports have a plurality of notches 41 formed therein along a length thereof.

A cover 42 is dimensioned for positioning over the main support 12, the cylindrical sleeves 28, the pair of handles 34 and the pair of garment supports 40. The cover 42 has a pair of apertures 44 in an upper end thereof for receiving the inwardly turned upper ends 38 of the handles 34 therethrough. The cover 42 has a zippered 46 closure. The cover 42 is constructed so as to be easily separated from the main support 12, the cylindrical sleeves 28, the pair of handles 34 and the pair of garment supports 40. Additionally, the cover 42 could be included with material that will allow greater adherence to the other components of the device 10.

In use, the adjustable shoulder straps 20 and the adjustable waist strap 22 are positioned over the shoulders and waist respectively of the user. The garment supports 40 are incorporated into the back of the device 10 in order to hold a quantity of garments positioned upon clothes hangers 48. Each of the garment supports 40 would be able to swing out to allow for the convenient loading of the garments on hangers 48 and then can be swung back. The inwardly turned upper ends 38 of the handles 34 allow for the user to grasp and manipulate the garment supports 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment bag backpack for freeing a user's hands while traveling comprising, in combination:

a main support having a generally rectangular configuration, the main support having a vertically oriented hinge extending across a central extent thereof, the main support having a short upper edge, a short lower edge and a pair of long side edges, the main support having a pair of shoulder straps secured thereto disposed inwardly of the long side edges thereof, the main support having a waist strap secured thereto disposed upwardly of the short lower edge, the shoulder straps and the waist strap coupling the main support to a torso of a user;

a pair of cylindrical sleeves secured to a rear surface of the main support, the sleeves being disposed in a parallel relationship with respect to the long side edges, the sleeves each having an open upper end and a closed lower end, the open upper end of one of the sleeves being disposed at a higher elevation than of the opposing sleeve;

a pair of handles rotatably disposed within the pair of cylindrical sleeves, each of the handles having an elongated shaft slidably received within the open upper ends of the sleeves, each shaft having an inwardly turned upper end;

a pair of garment supports secured to the elongated shafts of the pair of handles, the garment supports being orthogonally disposed with respect to the elongated shafts, each of the garment supports having a generally U-shaped configuration, the garment supports having a length less than a distance between the pair of cylindrical sleeves, the garment supports having a plurality of notches formed therein along a length thereof; and a cover dimensioned for positioning over the main support, the cylindrical sleeves, the pair of handles and the pair of garment supports, the cover having a pair of apertures in an upper end thereof for receiving the inwardly turned upper ends of the handles therethrough, the cover having a zippered closure.

2. A garment bag backpack comprising:

a main support having a pair of shoulder straps secured thereto, the main support having a waist strap secured thereto, the shoulder straps and the waist strap coupling the main support to a torso of a user;

a pair of garment supports rotatably coupled with the main support, each of the garment supports having a generally U-shaped configuration;

a cover dimensioned for positioning over the main support and the pair of garment supports, the cover having a zippered closure; and a pair of handles rotatable coupled with respect to the main support and the pair of garment supports, each of the handles having an elongated shaft, each shaft having an inwardly turned upper end.

3. The garment backpack as set forth in claim 2 and further including a pair of cylindrical sleeves secured to a rear surface of the main support, the sleeves being disposed in a parallel relationship with respect to long side edges of the main support, the sleeves each having an open upper end and a closed lower end, the open upper end of one of the sleeves being disposed at a higher elevation than of the opposing sleeve, the open upper ends receiving the elongated shafts of the pair of handles therein.

4. The garment backpack as set forth in claim 2 wherein the garment supports have a plurality of notches formed therein along a length thereof.

5. The garment backpack as set forth in claim 2 wherein the main support has a vertically oriented hinge extending across a central extent thereof.

6. A garment bag backpack comprising:

a main support having a pair of shoulder straps secured thereto, the main support having a waist strap secured thereto;

a pair of garment supports each including a vertical extent rotatably coupled within a sleeve on the main support and a horizontal extent extending therefrom, wherein the horizontal extents of the garment supports are vertically offset;

a cover dimensioned for positioning over the main support and the pair of garment supports, the cover having a zippered closure.

7. The garment backpack as set forth in claim 6 and further including a pair of handles rotatably coupled with respect to the main support and the pair of garment supports, each of the handles having an elongated shaft, each shaft having an inwardly turned upper end.

8. The garment backpack as set forth in claim 6 wherein the garment supports have a plurality of notches formed therein along a length thereof.

9. The garment backpack as set forth in claim 6 wherein the main support has a vertically oriented hinge extending across a central extent thereof.

* * * * *